US005338110A

United States Patent [19]

Byun

[11] Patent Number: 5,338,110

[45] Date of Patent: Aug. 16, 1994

[54] CIRCUIT, HAVING MULTIPLE SERIES RESONANT PATHS, FOR LIGHTING A BLINKING FLUORESCENT LAMP WITHOUT ADVERSELY AFFECTING LAMP LIFE

[75] Inventor: Jae H. Byun, Kyungki, Rep. of Korea

[73] Assignee: Seon Woong Koh, Seoul, Rep. of Korea

[21] Appl. No.: 50,892

[22] Filed: Apr. 21, 1993

[30] Foreign Application Priority Data

Apr. 22, 1992 [KR] Rep. of Korea ..... 92 6760

[51] Int. Cl.[5] ..... H05B 39/00

[52] U.S. Cl. ..... 315/94; 315/216; 315/226; 315/241 R; 315/242; 315/106; 315/107

[58] Field of Search ..... 315/94, 216, 226, 241 R, 315/242, 106, 107

[56] References Cited

U.S. PATENT DOCUMENTS

| | | | |
|---|---|---|---|
| 4,346,297 | 8/1982 | Suzuki et al. | 315/107 |
| 4,763,239 | 8/1988 | Ball | 315/226 X |
| 5,250,877 | 10/1993 | Fischer | 315/107 X |
| 5,251,119 | 10/1993 | MacHara | 315/226 X |

FOREIGN PATENT DOCUMENTS 902834 4/1990 Rep. of Korea .

*Primary Examiner*—Robert J. Pascal
*Assistant Examiner*—Reginald A. Ratliff
*Attorney, Agent, or Firm*—Peter L. Michaelson

[57] ABSTRACT

A circuit for lighting a fluorescent lamp. The present invention takes into account the fastidious characteristics of the fluorescent lamp, and during the momentary lighting of the fluorescent lamp. In order to reduce the temperature fluctuations, a separate pre-heating power is supplied. The circuit includes: a first resonance circuit consisting of a first capacitor connected to the opposite ends of the fluorescent lamp, a resonance inductor, a second capacitor, a first switch and a DC power source, serially connected; a second resonance circuit consisting of a second switch, a first capacitor, a resonance inductor, a third capacitor and a DC power source, serially connected; a switch control circuit for activating the first and second switches in an alternate manner. Before the lighting of the fluorescent lamp, the first and second resonance circuits are put to a resonance state, while, after the lighting of the fluorescent lamp, the resonance is eliminated.

3 Claims, 3 Drawing Sheets

CIRCUIT, HAVING MULTIPLE SERIES RESONANT PATHS, FOR LIGHTING A BLINKING FLUORESCENT LAMP WITHOUT ADVERSELY AFFECTING LAMP LIFE

FIELD OF THE INVENTION

The present invention relates to a circuit for lighting a fluorescent lamp which enables automatic blinking operation continuously like in an advertising panel.

BACKGROUND OF THE INVENTION

The conventional fluorescent lamp lighting circuits include a starting lamp type, a rapid starting type and an electronic type. The fluorescent lamp used in such lighting circuits is superior over the incandescent lamp, because the fluorescent lamp has a higher light emitting efficiency and a longer life expectancy than the incandescent lamp. However, a starting time for lighting the fluorescent lamp is lengthy. If the fluorescent lamp is operated to repeatedly blink, its life is greatly decreased. For this reason, fluorescent lamps could not be used for the case where the lamps continuously blink as in an advertising panel.

Further, a fluorescent lamp is greatly influenced by various external factors such as the lighting circuit, the performance of the starting switch(grow starter) and the ambient temperature. Consequently, the light flux are easily decreased, and the starting ability is easily degraded.

Further, during the lighting of the lamp, the starting voltage alteration and the fluctuation of the current act as impact pulses to the filament, thus resulting in a decrease of the light emission and the formation of dark specks. Accordingly the life expectancy of a fluorescent lamp largely depends on the number of lighting manipulations.

Korean Utility Model Publication No. 90-2834 (issued Apr. 4, 1990) discloses an attempt to overcome the above described disadvantages of the conventional fluorescent lamp lighting circuits. In this publication, if a fluorescent lamp is used as an ordinary illuminating means, lighting is started with a blocking oscillation voltage by using a DC power source without using a grow starter lamp, and a small AC voltage is applied to the fluorescent lamp heater so that the heater may not be damaged. In the case where the fluorescent lamp is used as an automatically blinking lamp, a low AC voltage is applied to the lamp heater all the time, thereby preventing the shortening of the fluorescent lamp life expectancy and the occurrence of dark specks. Thus a low voltage is applied to the lamp heater by an AC transformer all the time in order to prevent the damage of the heater. This reduces shortening of the life of a fluorescent lamp that would otherwise be caused by the damage of the heater during the lighting of the lamp. Therefore, a low AC voltage is made to be induced on the heater during the lighting of the lamp, and the polarity of the heater is continuously changed, thereby protecting the heater and extending the life expectancy of the heater.

However, the lighting circuit proposed by Korean Utility Model Publication No. 90-2834 has many problems in applying it to the practical use.

First, a power of 60 Hz is continuously supplied to the heater during the operation, and therefore, the power loss is very large. Further, the operating temperature of the fluorescent lamp is elevated, and this brings adverse effects such as the decrease of the light emitting efficiency and the shortening of the life expectancy.

Second, a flickering phenomenon inevitably occurs due to the connection characteristics of the oscillating circuit and the choke coil.

Third, the initiating current has to be very large, and therefore, the initiation becomes very unstable, as well as shortening the life expectancy.

Fourth, even during the time when the automatic blinking is not carried out, the AC power source continuously supplies the triggering pulses, with the result that the transistor connected to it is degraded and apt to malfunction.

SUMMARY OF THE INVENTION

It is an object of the present invention to provide a circuit for lighting an automatically blinking fluorescent lamp, in which, even if turning on/off operations are continuously carried out, the life expectancy of the fluorescent lamp is extended, as well as maintaining the light emitting efficiency.

The circuit of the present invention complements the disadvantages of the rapid lighting method and the electronic lighting method, and the automatic blinking is carried out in a stable manner, while the light emitting characteristic of the glow discharge tube is made uniform.

Meanwhile, when using it as a general illuminating lamp, a quick lighting is carried out by means of an oscillating circuit using a rectified DC current. The oscillating output which is supplied to the both side of the fluorescent lamp is almost sinusoidal wave, so that the life expectancy is extended, and that the generation of harmonics is sufficiently inhibited.

In achieving the above object, the circuit for lighting a fluorescent lamp includes: a first resonance circuit consisting of a first capacitor with its two electrodes connected to the opposite ends of the fluorescent lamp, a resonance inductor, a second capacitor, a first switch, and a DC power source which are connected in series; a second resonance circuit consisting of a second switch, a first capacitor, a resonance inductor, a third capacitor and a DC power source which are connected in series; and a switch control circuit for alternately activating the first switch and the second switch. Thus, before lighting the fluorescent lamp, the first and second resonance circuits are placed in a resonant state, and, when the fluorescent lamp is lighted, the resonant state is avoided.

The circuit for lighting a fluorescent lamp includes the first and second switches which respectively consist of a first FET and a second FET. The circuit further includes a switch control circuit which includes: a signal transformer for supplying control signals to the FETs; and a trigger circuit consisting of an integrator and a trigger diode, the integrator including a resistor and a capacitor.

The circuit further includes a switch control circuit which includes: a signal transformer for supplying control signals to the FETs; and a trigger circuit consisting of an integrator and a trigger diode, the integrator including a resistor and a capacitor. The trigger signals from the trigger circuit are supplied to one of the gates of the two FETs, and the signal transformer includes three coils. The first one of the three coils is connected to the resonant coil in series, and the second one is connected to between the source and gate of the first FET, while the third one is connected to between the source and gate of the second FET.

The circuit of the present invention further includes: a pre-heating circuit for pre-heating the fluorescent lamp; and a third switch for connecting AC power line to a rectifier converting AC to DC and the pre-heating circuit in an alternate manner. Thus when the fluorescent lamp is lighted by a DC power source, the pre-heating circuit is not activated.

Further, the third switch includes a relay having two contacts, and the first contact connects the AC power terminal to the rectifier, while the second contact connects the AC power terminal to the pre-heating circuit.

BRIEF DESCRIPTION OF THE DRAWINGS

The above object and other advantages of the present invention will become more apparent by describing in detail the preferred embodiment of the present invention with reference to the attached drawings in which.

DESCRIPTION OF THE PREFERRED EMBODIMENT

Figure 1:
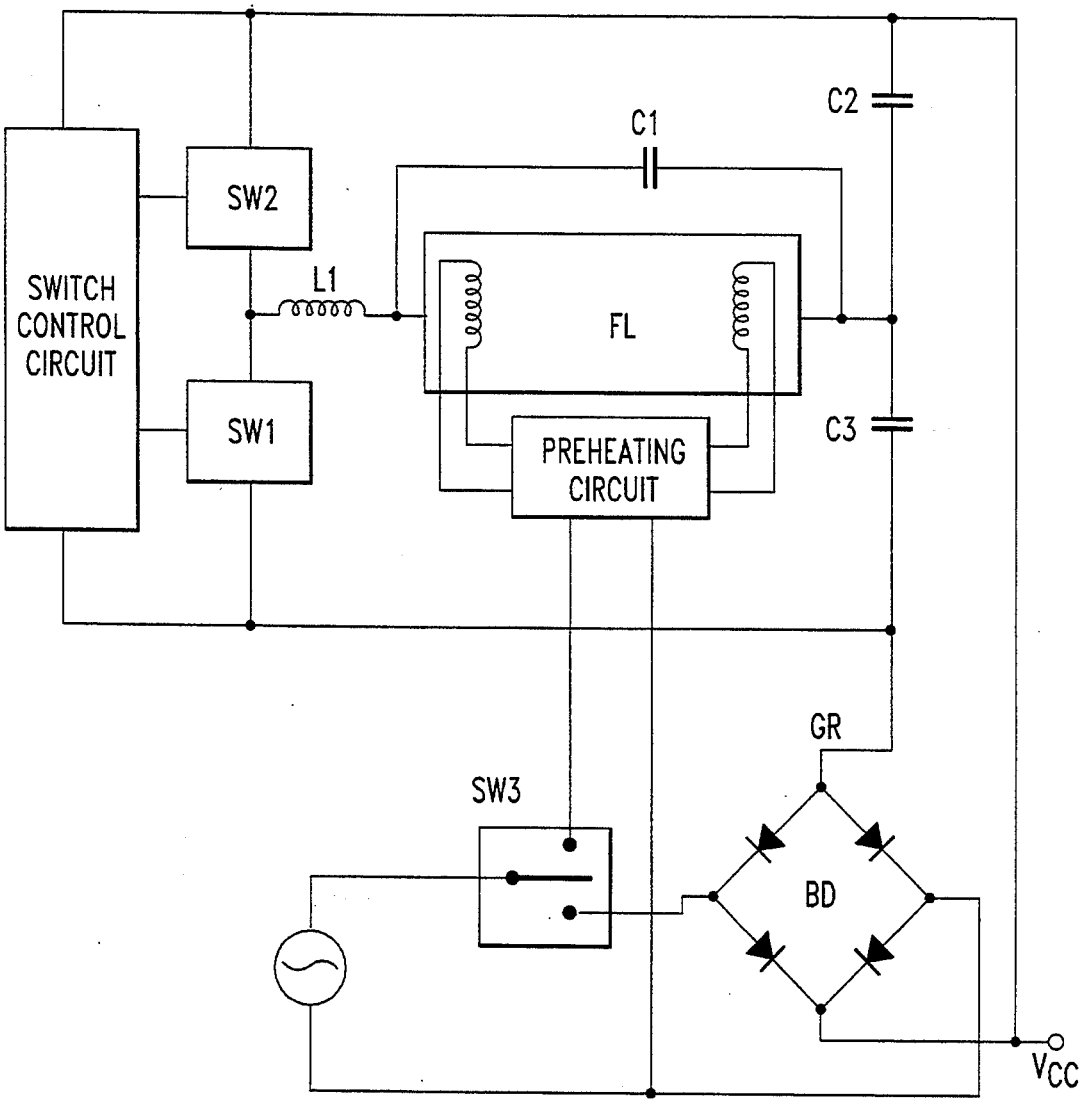
FIG. 1 is a block diagram showing the constitution of the circuit of the present invention.

FIG. 1 is a block diagram showing the constitution of the circuit of the present invention, and FIG. 2 illustrates the basic operations of lighting a fluorescent lamp of the present invention.

The circuit comprises basically two RLC serial resonance circuit (to be called "resonance circuit" below) for starting a fluorescent lamp, and a switching circuit. The resonance circuits comprise inductor, capacitors and resistors, and the switching circuit has two switches which control DC power supply to the fluorescent lamp.

Figure 2A:
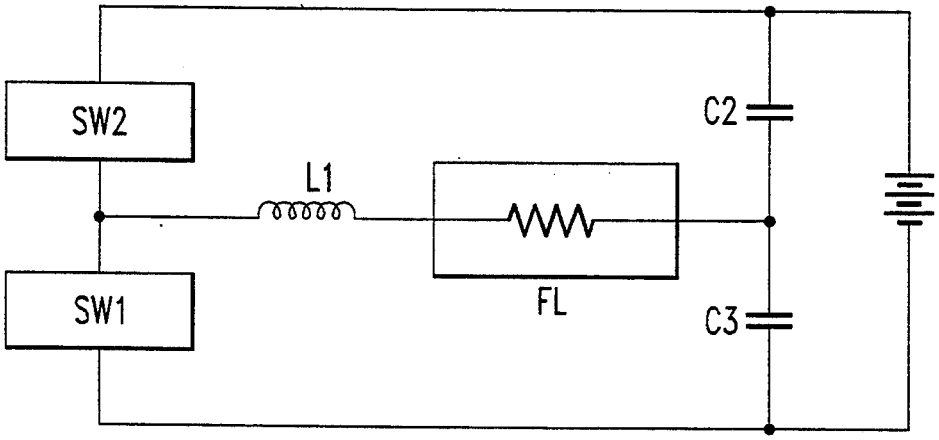
FIG. 2 (A), (B), and (C) illustrates the operation of the circuit of the present invention.
Figure 2B:
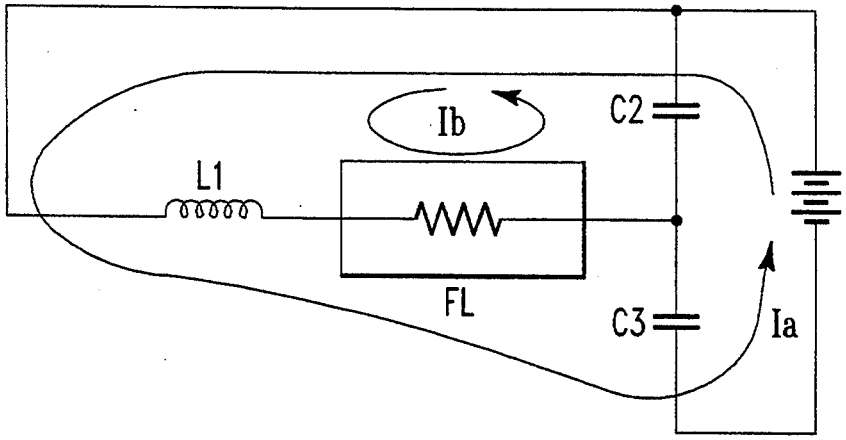
Figure 2C:
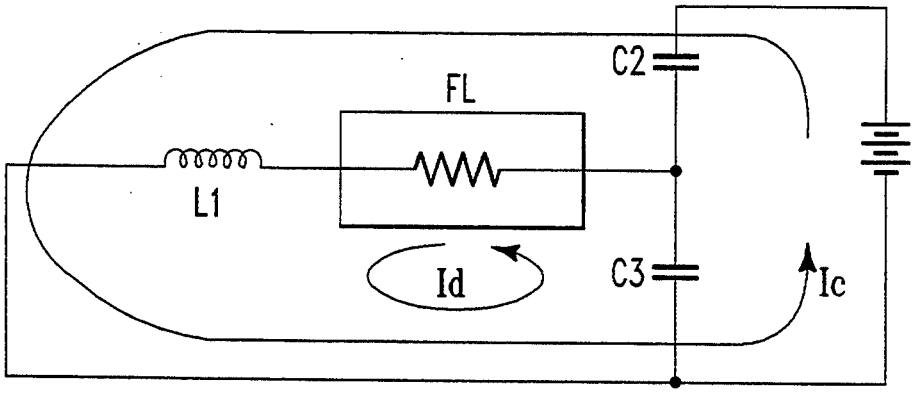

During the time the fluorescent lamp is turned on, lighting operation is: As shown in FIG. 2(A), a DC voltage is supplied to capacitor C2, C3, switch SW1, and SW2. Then the switch SW2 is turned on, while a switch SW1 is turned off. Then as shown in FIG. 2(B), a current Ia flows from a DC power source Vcc to charge a capacitor C3 through an inductor L1 and a lamp FL. The charge of the capacitor C2 is discharged through the inductor L1 and the lamp F1 to form a current Ib. Under this condition, the switch SW2 is turned off and the switch SW1 is turned on, then as shown in FIG. 2(C), a current Ic which is for charging the capacitor C2 flows through the lamp FL, the inductor L1 and the capacitor C2, and the capacitor C3 is discharged to make a current Id.

In order to make a fluorescent lamp current equal on the both direction of the fluorescent lamp, the current Ia+Ib and the current Ic+Id are made to flow equally, continuously and alternately, so that the dark specks due to the oxidation of the filament can be prevented. Particularly, in order to prevent the oxidation in the initial stage of the lighting of the lamp, there is added a pre-heating circuit which is driven by a low voltage AC power, and therefore, there occurs no problem during the periodic blinking.

As shown in FIG. 1, at the opposite ends of a rectifier BD for converting an AC voltage to a DC voltage, there is formed a first resonance circuit which includes a first switch SW1, a resonance inductor L1, a first capacitor C1 and a second capacitor C2 connected in series.

Meanwhile, to the opposite ends of the rectifier BD, there is provided a second resonance circuit which includes a second switch SW2, a resonance inductor L1 a first capacitor C1 and a third capacitor C3 connected in series.

In the first and second resonance circuits, the magnitude of the inductive reactance of the resonance inductor is made to be same as the combined capacitive reactance of the first and second capacitors C1 and C2, so that the resonance circuits perform a serial resonance. Further, the combined capacitive reactance of the first and third capacitors Cl and C3 is also made to be same as the inductive reactance of the resonance inductor.

The opposite electrodes of the fluorescent lamp FL is connected to the opposites terminals of the first capacitor C1, while control signals of the switch control circuit are supplied to the first and second switches. The switch control circuit turns on/off the first and second switches in an alternate manner, and they are turned on not simultaneously.

The second and third capacitors are connected between positive terminal Vcc and negative terminal GR of the rectifier BD, and the first and second switches are connected in series to the opposite terminals (Vcc and GR) of a DC power source. The first capacitor and the resonance inductor are connected in series to the connection point of the first and second switches, and to the connection point of the second and third capacitors.

The fluorescent lamp pre-heating circuit is connected to the filament of the fluorescent lamp, and the third switch SW3 connects AC power line either to the pre-heating circuit or to the rectifier BD in an alternate manner. The pre-heating circuit and the third switch are not essential for the general illumination purposes, and they can be omitted.

The above described circuit operates as follows:

First, if a DC voltage is supplied to the opposites ends of the first and second resonance circuits, the switch control circuit turns on one of the two switches (either first or second switch). For example, if the first switch is turned on first, the first and second capacitors C1 and C2 which are elements of the first resonance circuit are charged. When one half cycle of the resonance frequency passes, the switch control circuit turns off the first switch, and turns on the second switch.

Under this condition, the charges which are stored in the first and second capacitors are discharged through the resonance inductor and the second switch, while the third capacitor C3 is charged by the DC power source, the first capacitor C1 being charged in the opposite direction.

Again after one half cycle of the resonance frequency, the switch control circuit turns off the second switch, and turns on the first switch. Then the first and third capacitors are discharged through the resonance inductor and the first switch, and the first and second capacitor are charged again, such operation cycle being repeated. The first capacitor and the resonance inductor are commonly connected to the first and second resonance circuits, and therefore, a high resonance voltage is produced on the opposite ends of the first capacitor due to the series resonance. Owing to this high voltage, the fluorescent lamp which is connected to the opposite ends of the first capacitor starts to light. When the fluorescent lamp is lighted, a current flows through the fluorescent lamp, and therefore, the resonance state is eliminated, so that the voltage on the opposite ends of the first capacitor is reduced.

In addition to the decrease of the resonance voltage, the resonance inductor serves as a stabilizer, so that an over current of the fluorescent lamp should be prevented. Thus the optimum tube current and tube voltage are maintained, thereby the fluorescent lamp is operated in an ideal manner.

The third switch SW3 connects the rectifier and the preheating circuit to the AC power source in an alternate manner. The pre-heating circuit which pre-heats the fluorescent lamp does not operate, while the fluorescent lamp is being lit by the DC power source. The pre-heating circuit supplies a pre-heating voltage to the filament of the fluorescent lamp. As this pre-heating voltage is an AC voltage, the polarization of the ions are prevented, so that the light emitting function of the lamp should become smooth. Further, the influence from the ambient temperature is reduced, thereby extending the life expectancy of the lamp.

Figure 3:
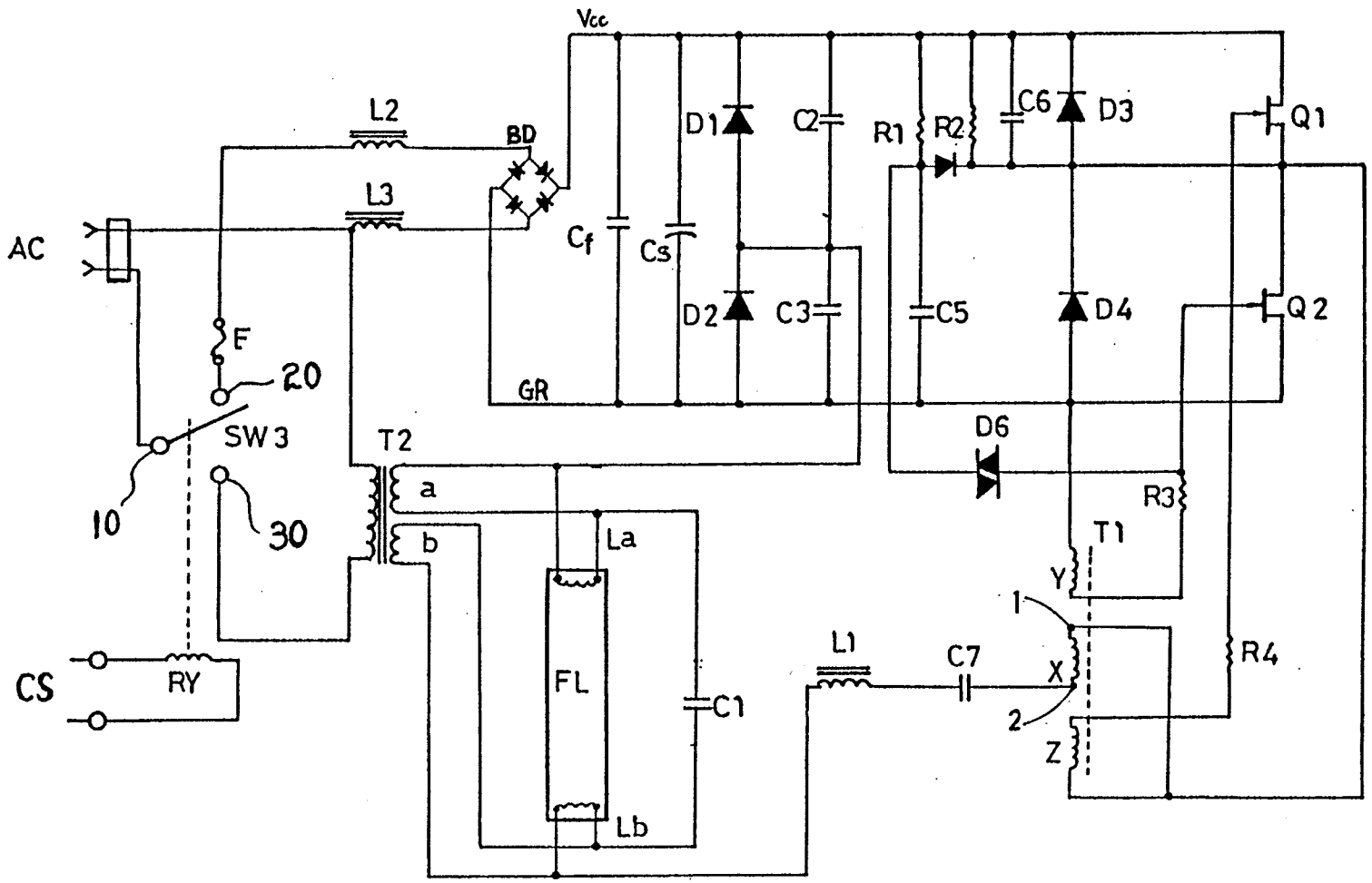
FIG. 3 is a circuit diagram of the preferred embodiment of the present invention.

FIG. 3 is a circuit diagram of the preferred embodiment of the present invention. The AC power source is supplied through a relay contact to a rectifier BD consisting of diode of a lighting circuit and to a pre-heating transformer T2 in an alternate manner. In AC loop after a relay contact a fuse F and a noise removing coils L2 and L3 are inserted before the rectifier BD. The output side of the rectifier BD is connected to a current flattening capacitor Cs and to a noise removing capacitor Cf. The current flattening capacitor is connected to serially connected switching FETs Q1 and Q2, and to resonance capacitors serially connected C2 and C3. An electrode La of the lamp, a coil "a" of the pre-heating transformer T2, a discharge triggering capacitor C1, an electrode Lb of the lamp, a coil "b" of the transformer T2, a resonance inductor L1, a current limiting capacitor C7, and a first coil of a signal transformer T1 are connected between the connection point of the resonance capacitors C2 and C3 and the connection point of the source and drain of a switching FET Q1 and Q2.

An electrode La of the lamp and coil a of the transformer T2 are connected in parallel. An electrode Lb of the lamp and the coil b of the transformer T2 are connected in parallel. The coils a and b of the transformer T2 are given a sufficient inductance to exclude interferences with the operating frequency of the fluorescent lamp.

The first and second switch SW1 and SW2 consist of a first FET Q1 and a second FET Q2, respectively and the switch control circuit which includes: a signal transformer T1 for supplying control signals to the FETs, a triggering circuit which has an integrator and a trigger diode D6. The integrator consisting of a resistor R1 and a capacitor C5. The trigger signals are supplied to one of the gates of the two FETs. In this embodiment shown in FIG. 3, the trigger signals are connected to the gate of the second FET Q2.

The signal transformer has three coils. The first coil X is connected to the resonant coil L1 in series. A second coil Z is connected between the source and gate of the first FET Q1, and a third coil Y is connected between the source and gate of the second FET Q2.

The third switch SW3 includes a relay having two contacts, the first contact 20 and the second contact 30. The first contact connects a AC power terminal 10 to the rectifier BD, while a second contact 30 connects the AC power terminal 10 to the pre-heating circuit T2. The relay is controlled by control signal CS which is provided for blinking operation.

Diodes D1 and D2 are for balancing the reverse induction voltage, and diodes D3 and D4 are for protecting the transistors Q1 and Q2. Capacitor C7 is for preventing a DC over voltage, and a diode D5 and a capacitor C5 are for opening a discharge path. A diode D6 is a diac or a trigger diode.

The driving of the circuit is carried out in such a manner that, if the power is supplied, a tiny current flows from the terminal Vcc through the resistor R2 and through a first pin 1 and a second pin 2 of the coil X of the transformer T1 to the C7, L1, C1, C3 and GR. During this process, the capacitors C2 and C3 are also charged.

Under this condition, if the voltage of the charged capacitor C5 is increased to over a predetermined level in the integrator which consists of a resistor R1 and a capacitor C5, then the diac C6 is turned on. The voltage supplied through the diac D6 turns on the switching FET SW2 (Q2), so that the charged voltage of the capacitor C3 discharges with a path through La, C1, Lb, L1 and C7 and through the second pin 2 and the first pin 1 of the coil X of the transformer T1 to the switching FET Q2. At this time second capacitor C2 is also charged.

Thereafter, an reverse induction voltage is induced in the inductor L1, and the switching transistor SW1 (Q1) is activated by the voltage induced in the coil Z of the transformer T1. The voltage which is induced in the coil Y of the transformer T1 has an opposite polarity, so that the transistor Q2 could not be turned on. Consequently, the terminal Vcc supplies a current through the switching FET Q1, through the first pin 1 and the second pin 2 of the transformer T1, and through C7, L1, Lb, C1, La, C3 and GR, thereby initiating oscillations.

Before the fluorescent lamp starts to light, the equivalent resistance of the lamp is several MQ, and therefore, almost the total current of the resonance circuit passes through the discharge initiating capacitor C1, thus a high voltage which is necessary for initiating the glow discharge is generated by the series resonance. The fluorescent lamp starts a glow discharge at a voltage of 360–400 V, and this voltage is accumulated upon starting of the oscillations.

If the lamp starts a glow discharge, the equivalent resistance of the lamp is decreased, and therefore, the current flows through the lamp rather than through the capacitor C1 which is high impedance compared to the fluorescent lamp. Consequently, the frequency is varied, and the series resonance does not occur.

The relay RY of the third switch SW3 and the transformer T2 of the pre-heating circuit extends the life expectancy of the fluorescent lamp which requires frequent turning on and off. Further, they also prevent the formation of dark specks, and therefore, they can be omitted in the case where the lamp is used for the general illumination.

If the relay is activated before the activation of the initial lighting device, and thus, if an AC power of 220 V is supplied to the primary coil of the transformer T2, the secondary coils "a" and "b" of the transformer T2 pre-heat the filaments La and Lb of the lamp with a low AC voltage.

Under this condition, the pre-heating voltage facilitates an emission of electrons making ions from the filaments, and the polarization of the ions is prevented. Further, the influence from the ambient temperature is reduced to ultimately reduce the temperature fluctuations, thereby extending the life expectancy of the fluorescent lamp.

According to the present invention as described above, the undesirable features of the pre-heating of the rapid start method and the electronic lighting are complemented, and the application field of the fluorescent lamp is expanded to a area using neon signs and advertising mirrors, as well as to the general illuminating means. Further, the fluorescent lamp of the present invention gives an energy saving effect.

What is claimed is:

1. A circuit for lighting a fluorescent lamp with DC power which is supplied to opposite ends of the fluorescent lamp by means of control switches, said DC power having been converted from incoming AC power, said circuit comprising:

a first resonance circuit including a first capacitor Cl having two electrodes connected to the opposite ends of the fluorescent lamp, a resonance inductor L1, a second capacitor C2, a first switch SW1, and the DC power source which are connected in series;

a second resonance circuit including said first capacitor Cl, said resonance inductor L1, a third capacitor C3, a second switch SW2, and the DC power source which are connected in series;

a switch control circuit for closing said first switch SW1 and the second switch SW2 in an alternating manner; and wherein said first and second resonance circuits are placed in a resonance state until the fluorescent lamp starts lighting and the resonance state is eliminated once the fluorescent lamp starts lighting; and said circuit further comprises:

a pre-heating circuit for pre-heating filaments in the fluorescent lamp;

a rectifier for converting AC power to the DC power, and a third switch SW3 for alternately connecting the incoming AC power either to said rectifier or to said pre-heating circuit, such that the incoming AC power is supplied to said pre-heating circuit, so as to activate said pre-heating circuit, until the fluorescent lamp starts lighting and the AC power is removed from the pre-heating circuit, so as to de-activate the pre-heating circuit, when the fluorescent lamp starts lighting.

2. The circuit as claimed in claim 1, wherein said first and second switches comprise a first FET Q1 and a second FET Q2 respectively;

said switch control circuit comprises a signal transformer T1 for supplying control signals to the FETs, and a triggering circuit which has a trigger diode D6 and an integrator consisting of a resistor R1 and a capacitor C5, for generating a trigger signal to be supplied to one of the gates of said first or second FET; and said signal transformer has three coils, the first coil X being connected to the resonant coil L1 in series, the second coil Z being connected between a source and gate of the first FET Q1, and the third coil Y being connected between a source and gate of the second FET Q2.

3. The circuit as claimed in claim 1, wherein said third switch SW3 includes a relay having two contacts, the first one of said contacts connecting an AC power terminal to said rectifier, and the second one of said contacts connecting the power terminal to said pre-heating circuit, said relay connecting said first and second ones of said contacts to the AC power terminal in an alternating fashion, and said relay is controlled by control signal CS which is provided for a blinking operation.

* * * * *